United States Patent [19]

Janovac

[11] Patent Number: 4,491,517

[45] Date of Patent: Jan. 1, 1985

[54] MULTI-DIMENSIONAL SCREEN

[75] Inventor: Stephen J. Janovac, Euclid, Ohio

[73] Assignee: W. S. Tyler Incorporated, Mentor, Ohio

[21] Appl. No.: 564,794

[22] Filed: Dec. 23, 1983

[51] Int. Cl.[3] ..... B07B 1/49

[52] U.S. Cl. ..... 209/401; 139/425 R; 210/499

[58] Field of Search ..... 209/401–403; 210/499; 139/425 R, 425 A, 384 R

[56] References Cited

U.S. PATENT DOCUMENTS

| | | | |
|---|---|---|---|
| 2,154,530 | 4/1939 | Robins | 209/401 |
| 2,926,785 | 3/1960 | Sander | 209/401 |
| 3,716,138 | 2/1973 | Lumsden | 209/401 |

FOREIGN PATENT DOCUMENTS

| | | | |
|---|---|---|---|
| 630975 | 11/1961 | Canada | 139/425 R |
| 956187 | 4/1964 | United Kingdom | 139/425 R |

*Primary Examiner*—Bernard Nozick
*Attorney, Agent, or Firm*—Robert L. Olson

[57] ABSTRACT

A screen (10) for separating particles according to size, being made up of a plurality of first straight wires (14) extending in one direction, and a plurality of alternating crimped second wires (12) extending in the same direction. A plurality of third straight wires (16) extend in the other direction, and are interwoven with each of the first and second wires. The first wires are 1½ to 2½ times the diameter of the second and third wires, which are of the same diameter.

4 Claims, 3 Drawing Figures

MULTI-DIMENSIONAL SCREEN

BACKGROUND OF THE INVENTION

Screens have been used to separate materials according to size for a long time. Constant effort has been made over the years to improve the screening or separating operation. Many improvements have resulted over the years. For example, better materials for the wires has increased the life of the screens. Adding vibratory motion to a screen separator increased the capacity of a given sized screen, and also reduced "blinding", or the plugging up of the screen openings. This reduced the "downtime" of a separating machine, necessary for the purpose of cleaning the screen. In spite of the advances that have been made in the art, there is still room for improvement.

SUMMARY OF THE INVENTION

The present invention is directed to a screen constructed so as to have a number of advantages over present day screens. The screen of the invention is woven so as to have all four wires surrounding each opening in the screen lying in different planes. This results in a screen that reduces "blinding". It also results in more efficient and greater capacity of separation for a screen of a given size. The screen is also a long wearing one.

DESCRIPTION OF THE PREFERRED EMBODIMENT

Figure 1:
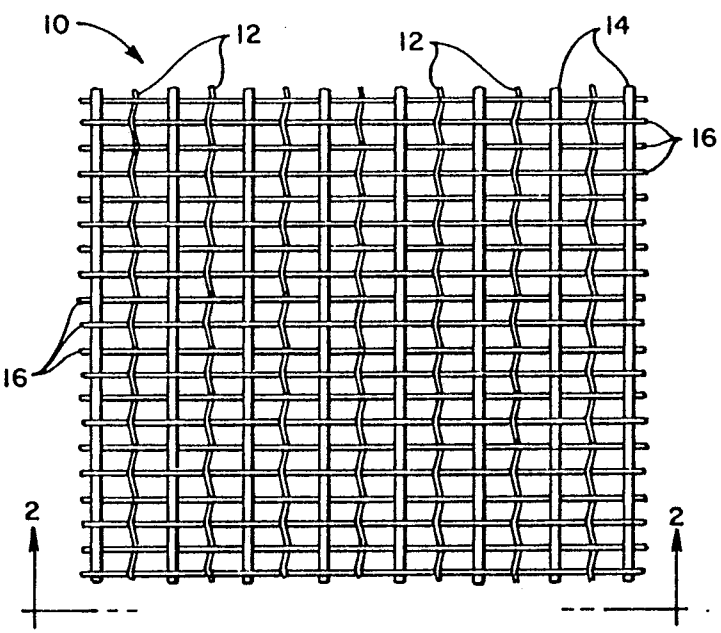
FIG. 1 is a plan view of a screen constructed in accordance with the invention.
Figure 2:
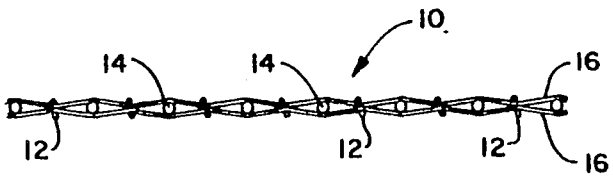
FIG. 2 is a side view taken on line 2—2 of FIG. 1.

Looking now to FIGS. 1 and 2, numeral 10 designates a screen for separating material according to size. This screen can be used to separate material in a machine which relies solely on gravity for separation, or it can also be used in a machine having a vibrating mechanism (not shown) which aids in the separating process. The cloth or screen 10 is constructed by alternating a crimped wire 12 with a straight wire 14 running in one direction. Extending in the other direction are a series of identical straight wires 16. Each wire is interwoven with the other wires in both directions; i.e., each wire 12 goes over one of the wires 16, and under the next. The same is true of the wires 14. Likewise, each alternating wire 16 goes over wire 12, and under the next adjacent wire 14. The next adjacent wire 16 goes under wire 12 and over wire 14. The resulting screen has openings, each of which is surrounded by four wires which each lie in a separate plane. The planes are accentuated from each other by the fact that the straight wires 14 are enlarged relative to the size of the other three wires 12 and 14, all of which are the same size. The resulting openings in the screen are thus 3-dimensional. For best results, the large wires 14 are $1\frac{1}{2}$ to $2\frac{1}{2}$ times the diameter of the other wires.

The above results in a wire screen or cloth which produces many advantages. The primary advantage is that the screen is not readily susceptible to "blinding", or plugging of the openings. This is particularly advantageous in a small mesh screen, or when the material being separated has a high moisture content, where blinding is a big problem normally. Also, the large wires 14 add strength to the screen, increasing its wear life. The use of one or more crimped wires keeps the wires from moving relative to each other, thus maintaining the proper mesh size throughout its life. Although only one crimped wire has been illustrated, and three straight wires, other combinations could be used; i.e., two straight wires and two crimped wires could be used. It should be kept in mind, however, that the crimped wires generally have shorter useful wear life than straight wires do. It is desirable to use a straight wire for the enlarged wire, since it is easier to initially make the screen than if the large wire were crimped. There should also be an increase in percent open area for a given screen size because of the differential elevations of the wires 16; i.e., one going over each large wire 14, with the next adjacent going under, etc.

Figure 3:
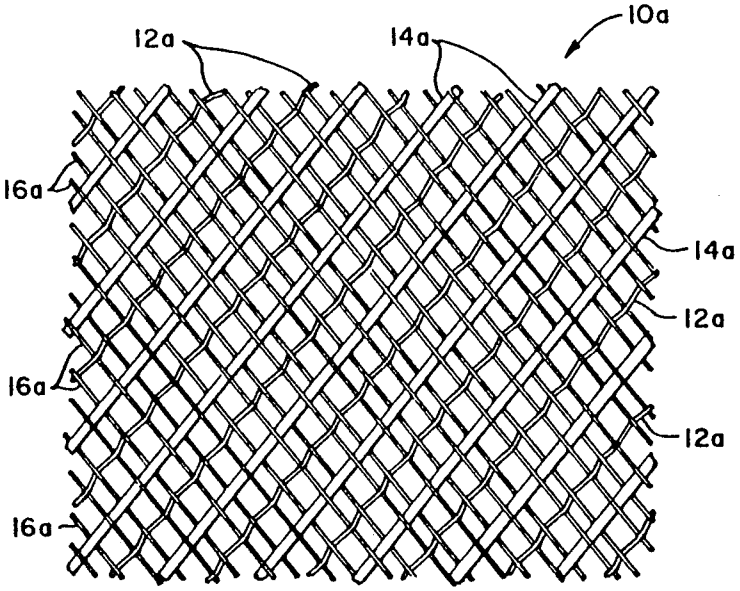
FIG. 3 is an alternative screen construction incorporating the invention.

FIG. 3 shows an alternative screen constructed in accordance with the invention. The wires are the same as shown in FIGS. 1 and 2, only a diamond weave is used. Thus large wires 14*a* alternate with small crimped wires 12*a* in one direction, and small straight wires 16*a* extend in the other direction.

I claim:

1. A screen for separating particles according to size, said screen being made up of a plurality of first wires of a first size extending in a first direction, a plurality of second wires, of a second size substantially larger than the first size, also extending in the first direction, said first and second wires alternating, with every other one being a first wire, and every other one being a second wire, a plurality of third wires extending in a second direction substantially transverse to the first direction, each of said third wires being interwoven with each of said first and second wires, with every other third wire extending over each first wire and under each second wire, and the alternating third wires extending under each first wire and over each second wire, so that the formed openings in the screen are 3-dimensional and the second wires are $1\frac{1}{2}$ to $2\frac{1}{2}$ times the diameter of the first and third wires.

2. The screen set forth in claim 1, wherein at least one of said plurality of first, second, or third wires is crimped.

3. The screen set forth in claim 1, wherein the first wires are crimped, and the second and third wires are substantially straight wires.

4. The screen set forth in claim 1, wherein the first and third wires are of the same diameter.

* * * * *